US011839946B2

(12) United States Patent
Chen

(10) Patent No.: US 11,839,946 B2
(45) Date of Patent: Dec. 12, 2023

(54) GRINDING MACHINE TOOL WITH RANDOM ECCENTRIC ORBITAL MOTION SPEED DETECTION

(71) Applicant: X'POLE PRECISION TOOLS INC., Taoyuan (TW)

(72) Inventor: Bach Pangho Chen, Claremont, CA (US)

(73) Assignee: X'POLE PRECISION TOOLS INC., Taoyuan (TW)

( * ) Notice: Subject to any disclaimer, the term of this patent is extended or adjusted under 35 U.S.C. 154(b) by 1142 days.

(21) Appl. No.: 16/533,452

(22) Filed: Aug. 6, 2019

(65) Prior Publication Data

US 2021/0039225 A1 Feb. 11, 2021

(51) Int. Cl.

| | |
|---|---|
| ***B24B 49/00*** | (2012.01) |
| ***B24B 49/10*** | (2006.01) |
| ***B24B 23/03*** | (2006.01) |

(52) U.S. Cl.

CPC ..... *B24B 49/006* (2013.01); *B24B 23/03* (2013.01); *B24B 49/10* (2013.01)

(58) Field of Classification Search

CPC ..... G01H 1/10; G01P 15/005; B24B 23/04; B24B 55/105; B24B 23/043; B24B 55/055; B24B 49/12; B24B 49/10; B24B 49/006

See application file for complete search history.

(56) References Cited

U.S. PATENT DOCUMENTS

| | | | |
|---|---|---|---|
| 6,004,197 A | 12/1999 | Huber | |
| 6,855,040 B2 | 2/2005 | Huber | |
| 6,979,254 B1 | 12/2005 | Huber | |

(Continued)

FOREIGN PATENT DOCUMENTS

| | | | |
|---|---|---|---|
| CN | 203863695 U * 10/2014 | ..... | A24F 47/00 |
| CN | 112007416 A * 12/2020 | ..... | B01D 29/27 |

(Continued)

OTHER PUBLICATIONS

English translation of Japanese Patent JP 2003114160 (2003) (Year: 2003).*

(Continued)

*Primary Examiner* — Joel D Crandall
(74) *Attorney, Agent, or Firm* — MUNCY, GEISSLER, OLDS & LOWE, P.C.

(57) ABSTRACT

A grinding machine tool with random eccentric orbital motion speed detection, the grinding machine tool comprises a body and a grinding disc, the body comprises a driving shaft and a tool holder connecting the grinding disc and having an eccentric distance relative to the driving shaft, and the grinding disc performs grinding in a random eccentric orbital motion when the driving shaft rotates. The grinding disc comprises at least one detected member on a side of the grinding disc facing the body for detecting a speed of the random eccentric orbital motion, and the at least one detected member defines a detection area with a range greater than or equal to twice the eccentric distance. Thereby, an accurate speed of the grinding disc performing the random eccentric orbital motion is obtained, so that the grinding operation of precision grinding which is gradually performed by automation is more precisely controlled.

17 Claims, 10 Drawing Sheets

(56) References Cited

U.S. PATENT DOCUMENTS

| | | | | |
|---|---|---|---|---|
| 2005/0245183 | A1 | 11/2005 | Deshpande et al. | |
| 2019/0193221 | A1 * | 6/2019 | Valentini | H02K 7/14 |

FOREIGN PATENT DOCUMENTS

| | | | | |
|---|---|---|---|---|
| EP | 3144110 | A1 * | 3/2017 | B23D 57/00 |
| EP | 3501753 | A1 * | 6/2019 | B24B 23/04 |
| JP | 2003114160 | A * | 4/2003 | G11B 25/043 |

OTHER PUBLICATIONS

English translation of Chinese Patent CN 112007416 (2020) (Year: 2020).*

* cited by examiner

GRINDING MACHINE TOOL WITH RANDOM ECCENTRIC ORBITAL MOTION SPEED DETECTION

FIELD OF THE INVENTION

The present invention relates to a grinding machine tool structure, and more particularly to a grinding machine tool for defining a detection range on a grinding disc for detecting a speed of a random eccentric orbital motion.

BACKGROUND OF THE INVENTION

A power tool for performing grinding operation or polishing operation is generally called a grinding machine tool in the industry. The driving method and the motion mode of a grinding disc to which the aforementioned grinding machine tool belongs can be mainly classified into three types, which are explained one by one hereinafter.

Referring to FIG. 1, the first driving method is to directly connect a driving shaft 311 of a motor 31 to a grinding disc 30, because of being driven directly, the rotation per minute (RPM) of the grinding disc 30 is equal to the rotational speed of the driving shaft 311, and only the rotational speed of the driving shaft 311 is required when the rotational speed of the grinding disc 30 is to be detected. On the other hand, in this driving method, each point on the grinding disc 30 is concentrically moved relative to the driving shaft 311, and the motion locus is as indicated by an arrow 40 in FIG. 2. Furthermore, such a driving method has also been shown in US patent number US 2005/0245183.

Referring to FIG. 3, the second driving method is to mount the grinding disc 30 on an eccentric shaft 32 which is eccentric relative to the driving shaft 311. The eccentric shaft 32 has an eccentric distance 321 relative to the driving shaft 311. The eccentric shaft 32 is coupled to the driving shaft 311 by a tool holder 33, wherein the tool holder 33 is a bearing. Furthermore, at least one rotation limiting member 34 is further disposed between the grinding disc 30 and the driving shaft 311, and the rotation limiting member 34 is made of an elastic material. The rotation limiting member 34 limits the grinding disc 30 only being capable of performing eccentric orbital motion relative to the driving shaft 311 instead of performing free rotation motion, and the motion locus of the grinding disc 30 is as shown in FIG. 4. Further, any point on the grinding disc 30 is eccentrically orbitally moved relative to the driving shaft 311, and the motion radius is equal to the eccentric distance 321. In this driving method, the grinding disc 30 is synchronized with the driving shaft 311, that is, the motion speed of the grinding disc 30 is equal to the rotational speed of the driving shaft 311. Therefore, only the rotational speed of the driving shaft 311 is required when an eccentric orbital motions per minute (OPM) of the grinding disc 30 is to be obtained.

Referring to FIG. 5, the third driving method is similar to the second driving method. The difference is that the third driving method does not have the rotation limiting member 34. The related patents can be found in U.S. Pat. Nos. 6,004,197, 6,979,254, and 6,855,040. The grinding disc 30 does not have a direct linkage relationship with the driving shaft 311. The rotation of the grinding disc 30 is dependent on the motor 31 reaching a certain rotational speed, and the eccentric shaft 32 generates an inertial centrifugal force to push the grinding disc 30 to rotate. The rotational speed of the grinding disc 30 is faster as the rotational speed of the driving shaft 311 is increased, but does not exceed the maximum rotational speed of the driving shaft 311. However, when the rotational speed of the driving shaft 311 is reduced or stopped, the grinding disc 30 can still be driven by the kinetic energy stored in the grinding disc 30 to continue to rotate until the stored kinetic energy is used up. Further, when the grinding disc 30 is driven by the inertial centrifugal force to rotate, in addition to performing a rotation motion centering on the eccentric shaft 32, the eccentric distance 321 between the eccentric shaft 32 and the driving shaft 311 causes the grinding disc 30 to simultaneously generate an eccentric orbital motion, and the motion locus formed by the two aforementioned motions added together is shown in FIG. 4. In addition, the grinding disc 30 actually performs a revolution motion relative to the driving shaft 311 at the same time, and the motion synthesized by the three kinds of aforementioned motions is called a random eccentric orbital motion, and the motion locus is as shown in FIG. 6. Therefore, under this driving structure, the revolution motion and the eccentric orbital motion of the grinding disc 30 are always synchronized with the rotational speed of the driving shaft 311. However, since the eccentric shaft 32 is eccentrically assembled with the driving shaft 311 via the tool holder 33, the grinding disc 30 contacts a surface of an object to be ground, the rotational speed of the grinding disc 30 will decrease due to the resistance generated by the contact. Furthermore, the shape of the surface of the object to be ground, the angular contact pressure of the grinding disc 30 in contact with the surface of the object to be ground, and the abrasive material used on the grinding disc 30 produce different resistances to reduce the rotational speed of the grinding disc 30. As a result, the rotational speed of rotation motion and the eccentric orbital motion of the grinding disc 30 are greatly different from the rotational speed of the driving shaft 311 during the operation, and the difference is constantly changing rapidly during the operation. Therefore, it is very difficult to detect the number of random eccentric orbital motions per minute (ROPM) of the grinding disc 30.

Furthermore, although many manufacturers have introduced grinding machine tools with rotational speed detection, in implementation, the rotational speed of the driving shaft 311 is regarded as the rotational speed of the grinding disc 30 by the aforementioned manufacturers. Once the grinding machine tool is implemented with the third driving method described above, the actual rotational speed of the grinding disc 30 cannot be reliably known, thereby affecting the grinding operation. Moreover, as technology advances, today's industrial precision grinding has gradually evolved toward automation, that is, the grinding machine tool will be disposed on a mechanical arm, but the mechanical arm needs accurate values for accurate control. Therefore, the practice of using the rotational speed of the driving shaft 311 as the rotational speed of the grinding disc 30 will be unable to accurately control the mechanical arm.

SUMMARY OF THE INVENTION

A main object of the present invention is to solve the problem of the incapability to detect the random eccentric orbital motion speed of a conventional grinding disc.

In order to achieve the above object, the present invention provides a grinding machine tool with random eccentric orbital motion speed detection, the grinding machine tool comprises a body and a grinding disc, the body comprises a driving shaft and a tool holder connecting the grinding disc and having an eccentric distance relative to the driving shaft, and the grinding disc performs grinding in a random eccentric orbital motion when the driving shaft rotates. Wherein the grinding disc is provided with at least one detected member on a side of the grinding disc facing the body for detecting a speed of the random eccentric orbital motion, and the at least one detected member defines a detection area with a range greater than or equal to twice the eccentric distance.

In one embodiment, one detected member is provided with the grinding disc, and two opposite boundaries of the detected member define a detection area with a range greater than or equal to twice the eccentric distance.

In one embodiment, a plurality of the detected members is provided on the side of the grinding disc, the plurality of detected members are located on a same extension line, one of the plurality of detected members is located at a center of the detection area, and two of the plurality of detected members are respectively spaced the eccentric distance apart with the one of the plurality of detected members located at the center of the detection area.

In one embodiment, the grinding machine tool comprises an active detection member that faces the grinding disc, and the active detection member detects the detected member without changing position when the grinding disc performs the random eccentric orbital motion to output a detection signal. Further, the active detection member is disposed on a side of the body facing the grinding disc, or the active detection member is externally attached to the body by a connection component.

In one embodiment, the active detection member comprises an output portion that emits a detection wave toward the at least one detected member, and a receiving portion that receives the detection wave reflected by the at least one detected member to output the detection signal. The detection wave is selected from one of a group consisting of a light ray, a radio wave, and a sound wave.

In one embodiment, the active detection member generates the detection signal based on a magnetic field strength changed by the detected member.

In one embodiment, the grinding machine tool comprises an information processing module that connects the active detection member and generates a random eccentric orbital motion rotational speed per minute data based on the detection signal. Further, the information processing module comprises a waveform processing unit and an operational processing unit, and operational processing unit connects to the waveform processing unit and analyzes a detection waveform signal outputted by the waveform processing unit to generate the random eccentric orbital motion rotational speed per minute data.

In one embodiment, the active detection member is disposed on the side of the body facing the grinding disc, and the information processing module is disposed in the body and connected to the active detection member.

With the foregoing implementation of the present invention, the present invention has the following features compared to the prior art: the present invention defines the detection area with a range greater than or equal to twice the eccentric distance by the at least one detected member disposed on the grinding disc, so that the speed at which the random eccentric orbital motion performed by the grinding disc can be detected, thereby allowing automated equipment to achieve more accurate control in precision industrial grinding, and increasing grinding operations that can be performed by automated equipment.

DETAILED DESCRIPTION OF THE PREFERRED EMBODIMENTS

The detailed description and technical content of the present invention is described with reference to the accompanying drawings as follows.

Figure 1:
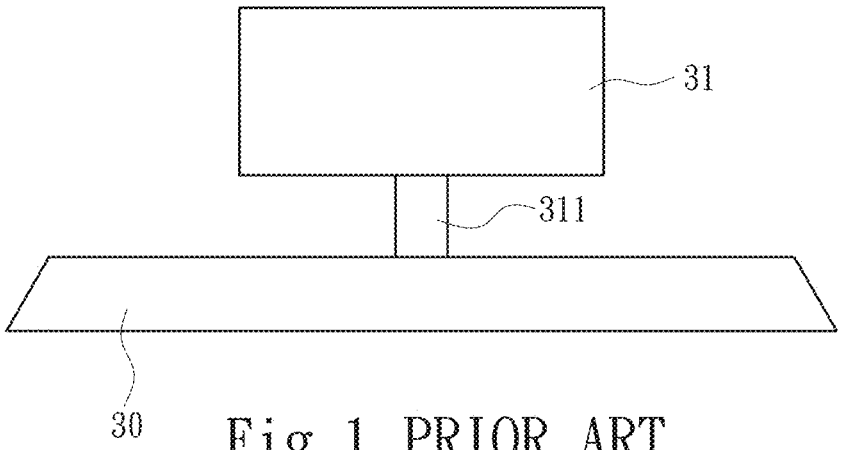
Fig. 1 PRIOR ART
FIG. 1 is a schematic diagram of a first type driving structure of the conventional grinding tool.
Figure 2:
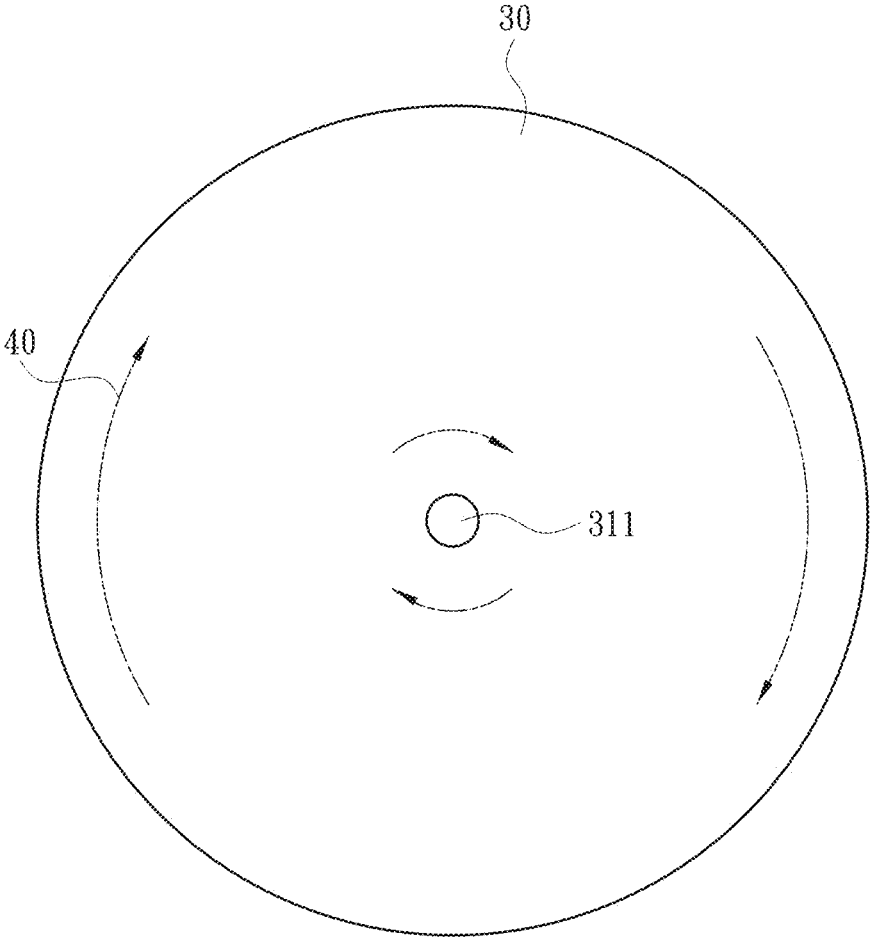
Fig. 2 PRIOR ART
FIG. 2 is a schematic diagram of a motion locus of a grinding disc of the first type driving structure of the conventional grinding tool.
Figure 3:
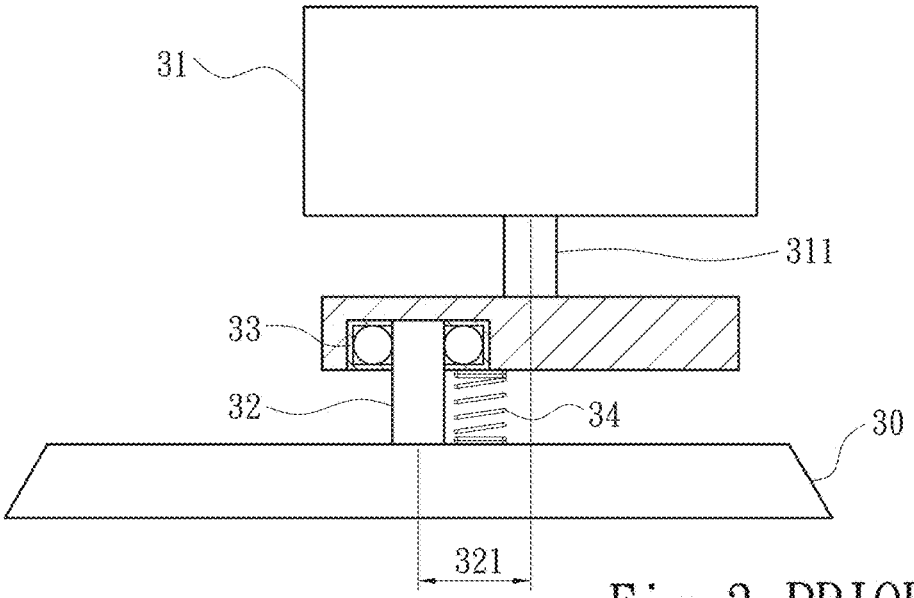
Fig. 3 PRIOR ART
FIG. 3 is a schematic diagram of a second type driving structure of the conventional grinding tool.
Figure 4:
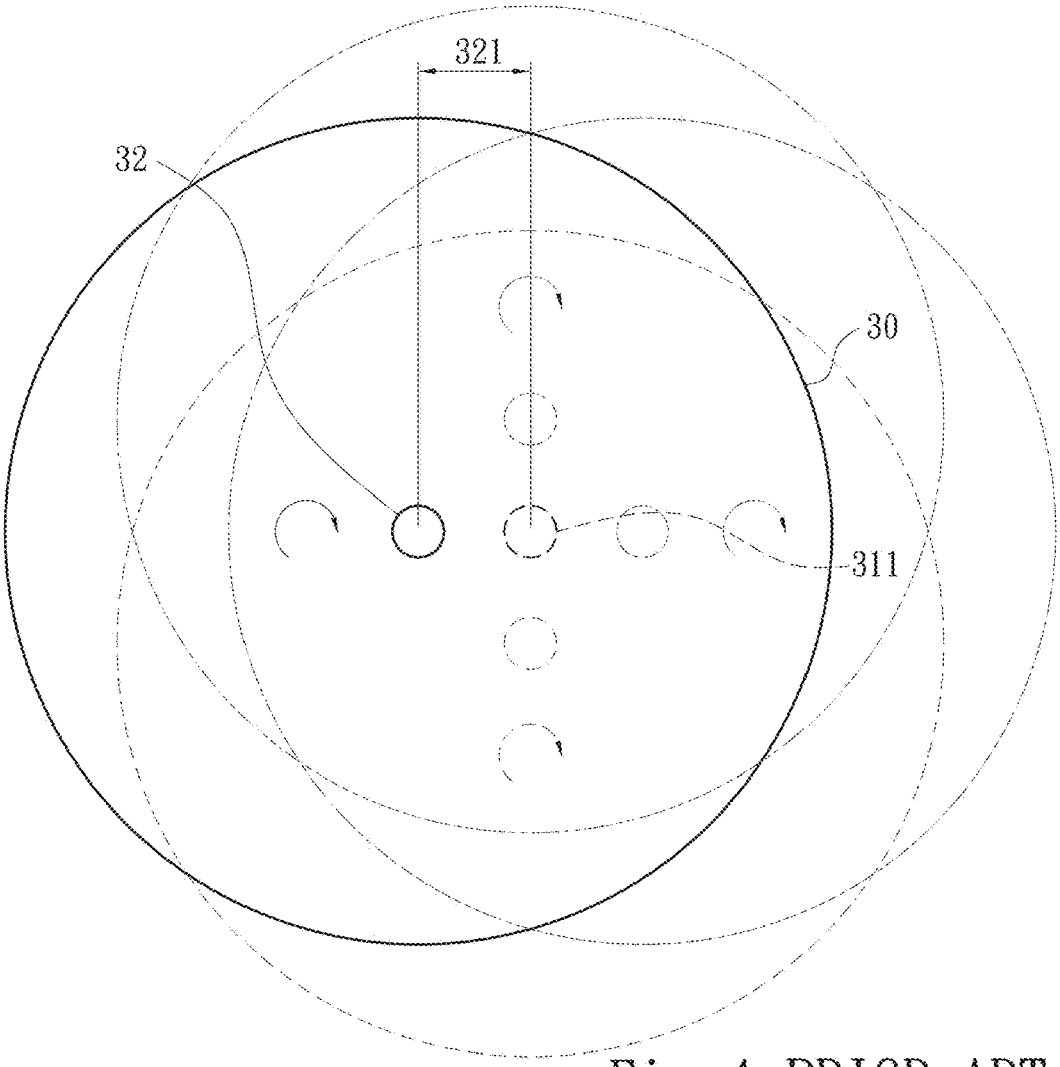
Fig. 4 PRIOR ART
FIG. 4 is a schematic diagram of a motion locus of a grinding disc of the second type driving structure of the conventional grinding tool.
Figure 5:
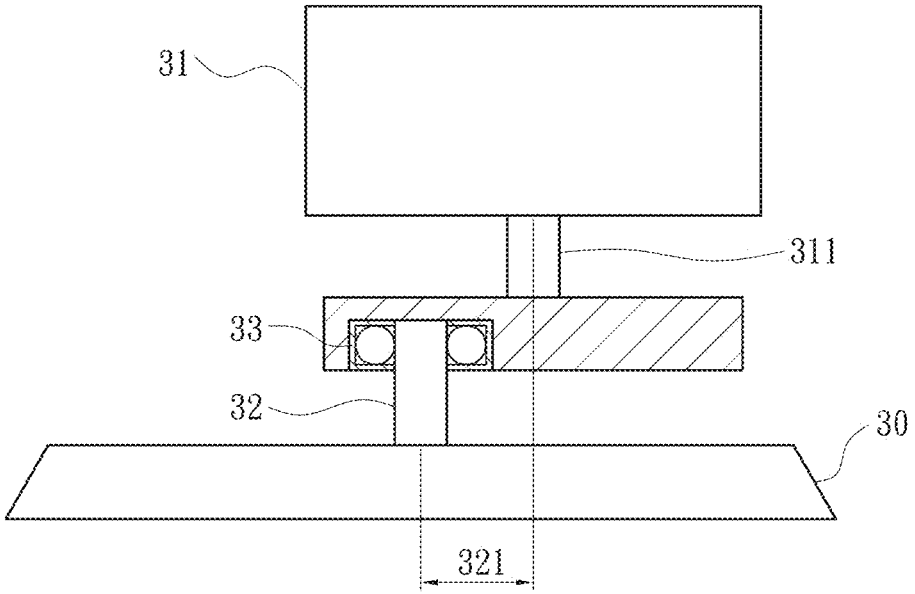
Fig. 5 PRIOR ART
FIG. 5 is a schematic diagram of a third type driving structure of the conventional grinding tool.
Figure 6:
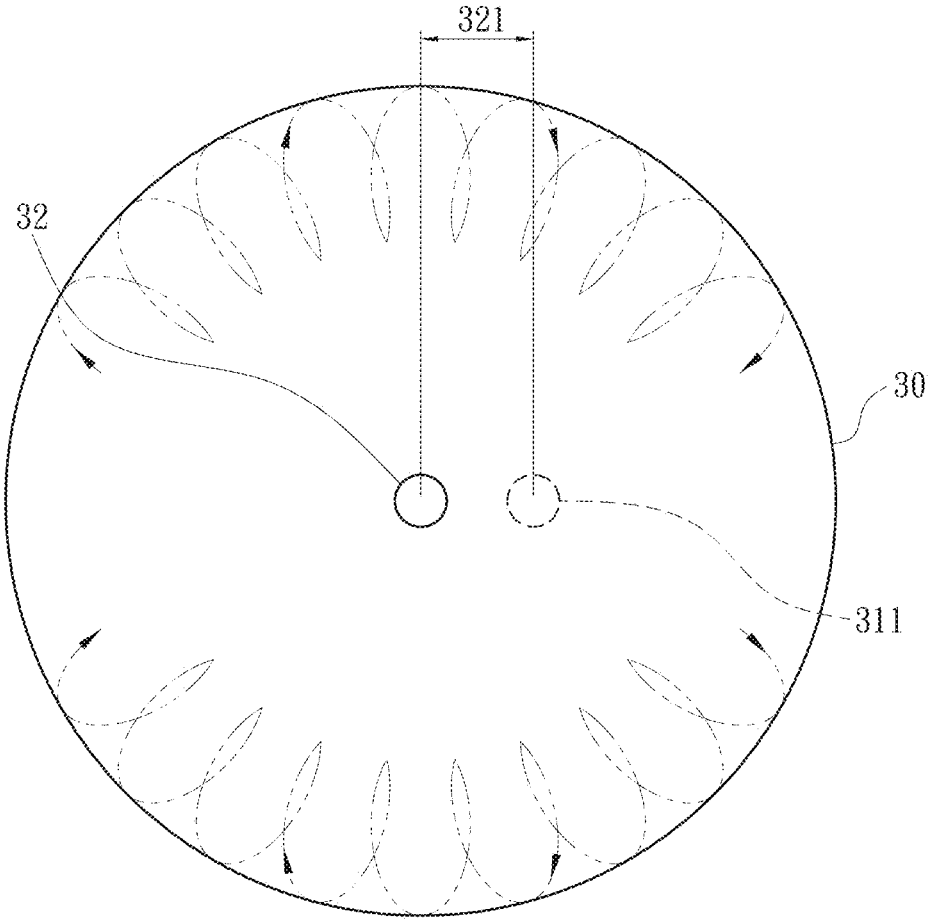
Fig. 6 PRIOR ART
FIG. 6 is a schematic diagram of a motion locus of a grinding disc of the third type driving structure of the conventional grinding tool.
Figure 7:
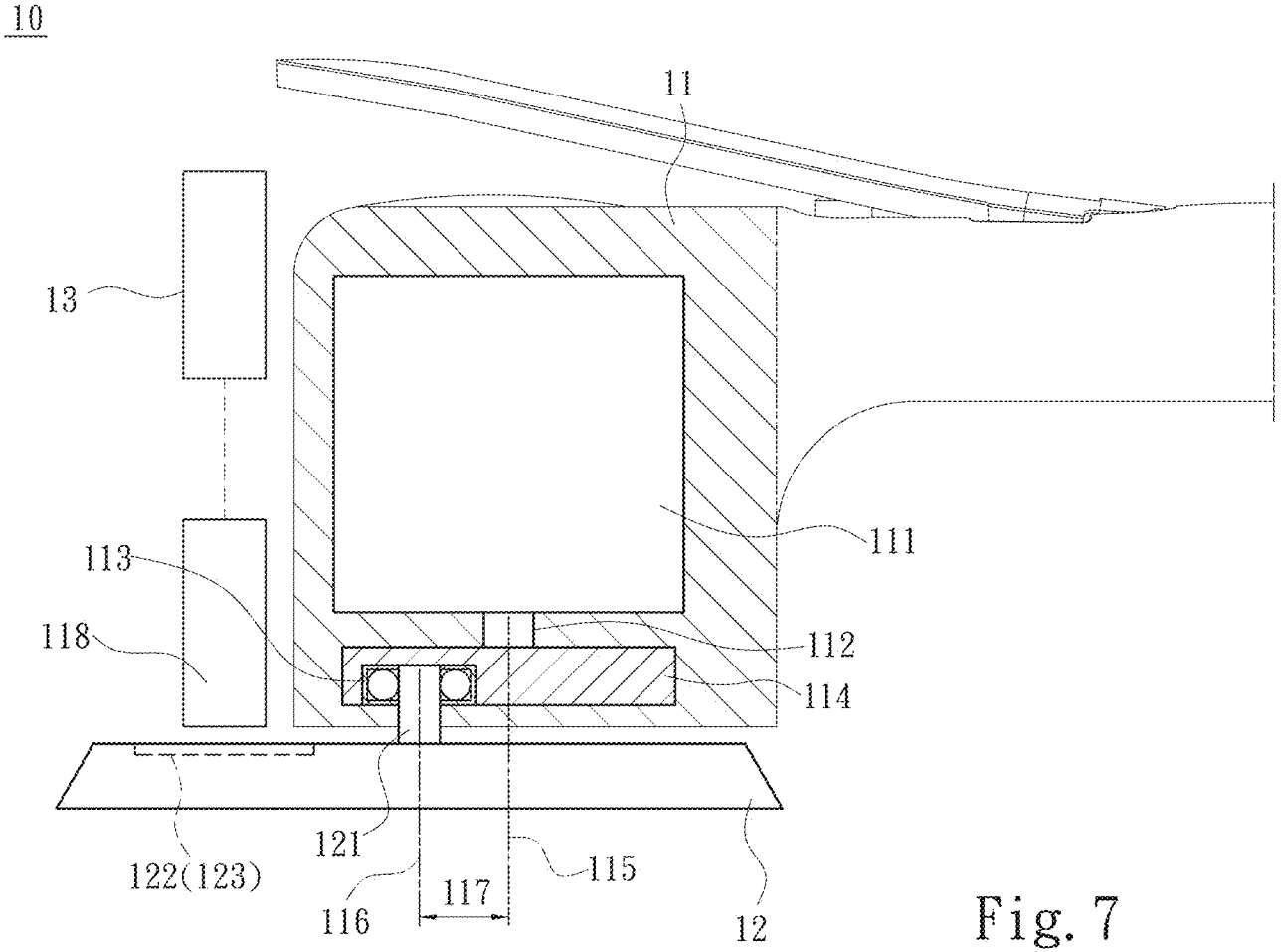
FIG. 7 is a first schematic diagram of the structure of a grinding machine tool of the present invention.
Figure 8:
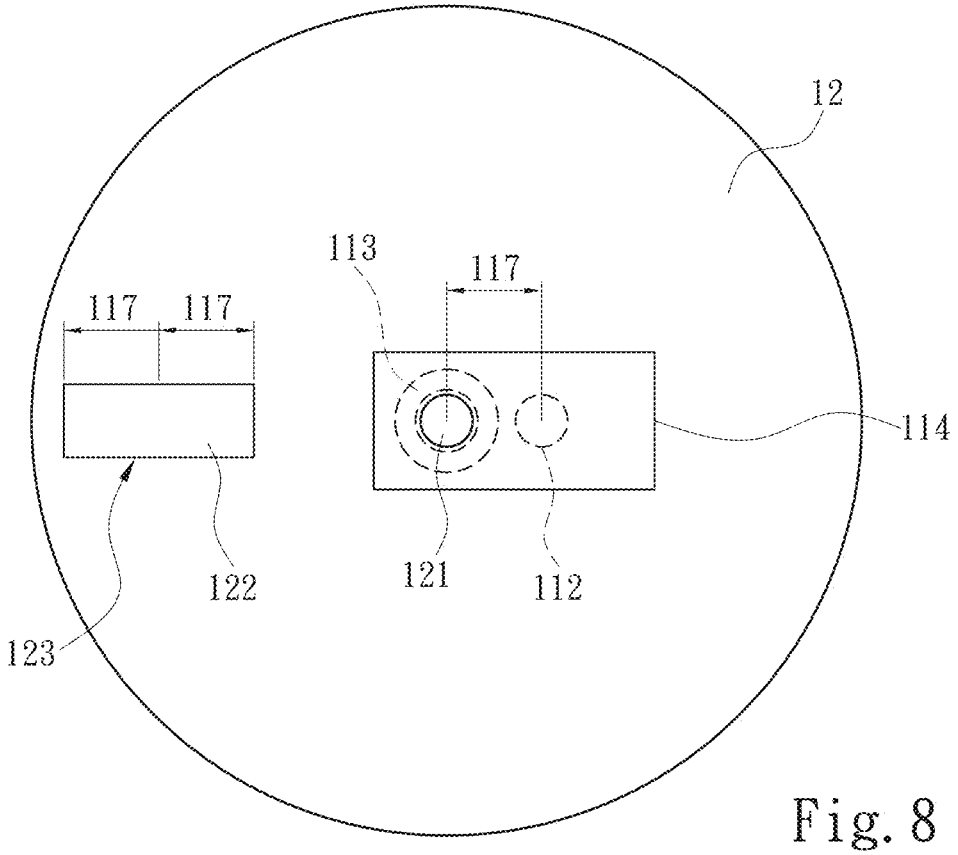
FIG. 8 is a first top view of the structure of a grinding disc of the present invention.

Referring to FIG. 7 and FIG. 8, the present invention provides a grinding machine tool 10, the grinding machine tool 10 may be disposed on an automated equipment (not shown in the figures), and the automated equipment may be referred to as a mechanical arm or the like. Further, the grinding machine tool 10 of the present invention may be used for polishing operations in addition to grinding operations. The grinding machine tool 10 comprises a body 11 and a grinding disc 12. In addition to a power component 111, the body 11 further comprises a driving shaft 112 driven by the power component 111, and a tool holder 113 connected to the grinding disc 12. The power component 111 may be implemented pneumatically or electrically depending on the implementation. Further, the driving shaft 112 is formed with an eccentric block 114, and the tool holder 113 is disposed on the eccentric block 114 and is eccentric relative to the driving shaft 112. Specifically, the driving shaft 112 includes a first axis 115, and the tool holder 113 includes a second axis 116 that is offset from the first axis 115. The first axis 115 and the second axis 116 have an eccentric distance 117 between them. Thus, the grinding disc 12 mounted on the tool holder 113 is eccentric relative to the driving shaft 112. Furthermore, the tool holder 113 may be a bearing or may be implemented as combination of a plurality of bearings. The grinding disc 12 is provided with a mounting member 121 coupled to the tool holder 113, and the mounting member 121 may be a column structure with which the tool holder 113 is matched and fitted. Accordingly, when the driving shaft 112 rotates, the grinding disc 12 will rotate in a random eccentric orbital motion.

Figure 9:
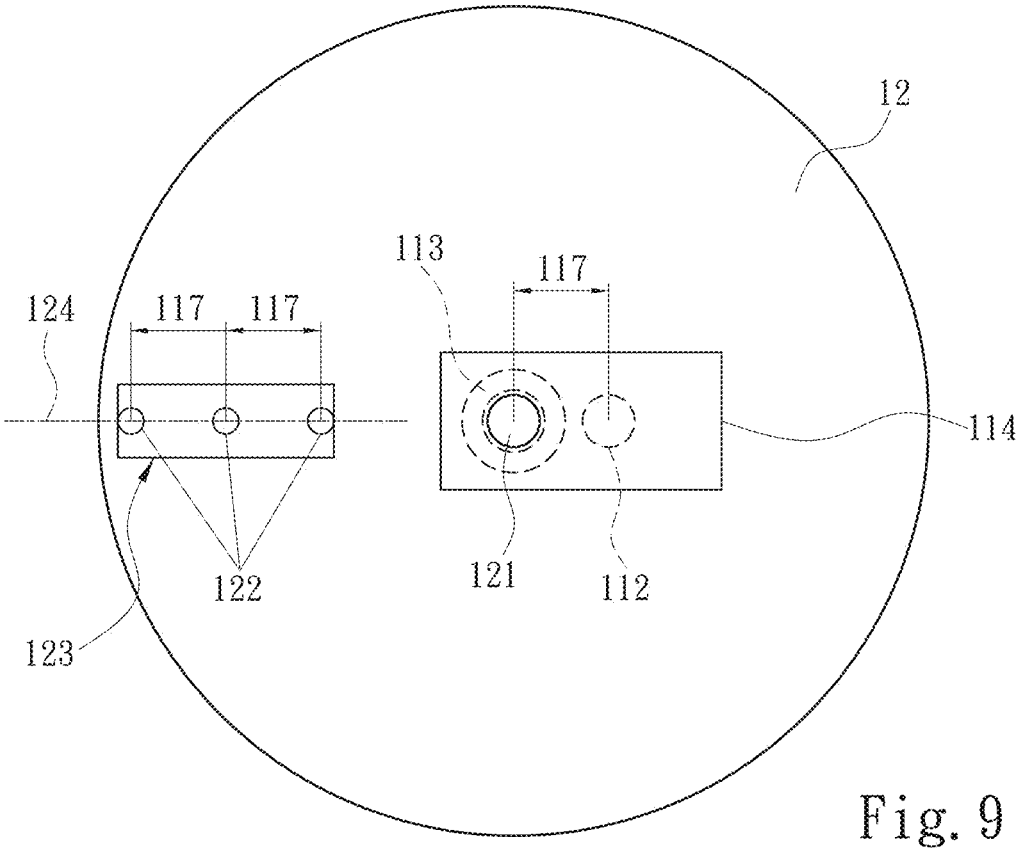
FIG. 9 is a second top view of the structure of the grinding disc of the present invention.

Referring to FIG. 7 and FIG. 8, the grinding disc 12 is provided with at least one detected member 122 on a side of the grinding disc facing the body 11, and the at least one detected member 122 defines a detection area 123 with a range greater than or equal to twice the eccentric distance 117. Accordingly, a quantity of the detected member 122 of the present invention may be adjusted according to the implementation. As shown in FIG. 8, when only one detected member 122 is provided with the grinding disc 12, the range of the detection area 123 is defined by two opposite boundaries of the detected member 122. Referring to FIG. 9, when the grinding disc 12 is provided with a plurality of the detected members 122, the range of the detection area 123 is defined based on the detected members 122 respectively located at two opposite edges. Further, when a quantity of the plurality of detected members 122 is plural, the plurality of detected members 122 may be orderly arranged in a row in the detection area 123. For example, as shown in FIG. 9, a plurality of the detected members is provided on the side of the grinding disc, and the plurality of detected members 122 are located on a same extension line 124, one of the plurality of detected members 122 is located at a center of the detection area 123, and two of the plurality of detected members are respectively spaced the eccentric distance apart with the one of the plurality of detected members located at the center of the detection area.

Figure 10:
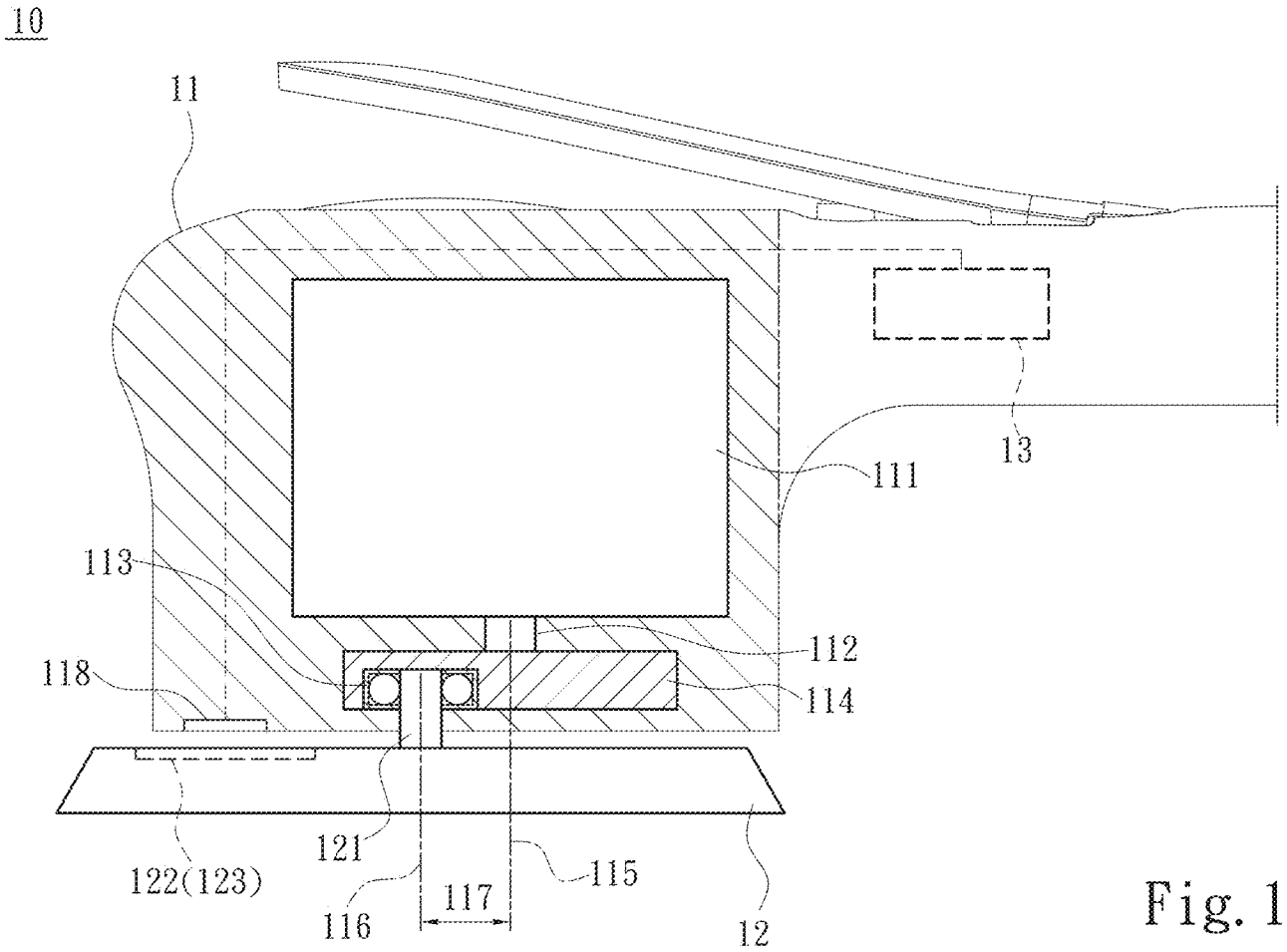
FIG. 10 is a second schematic diagram of the structure of the grinding machine tool of the present invention.
Figure 11:
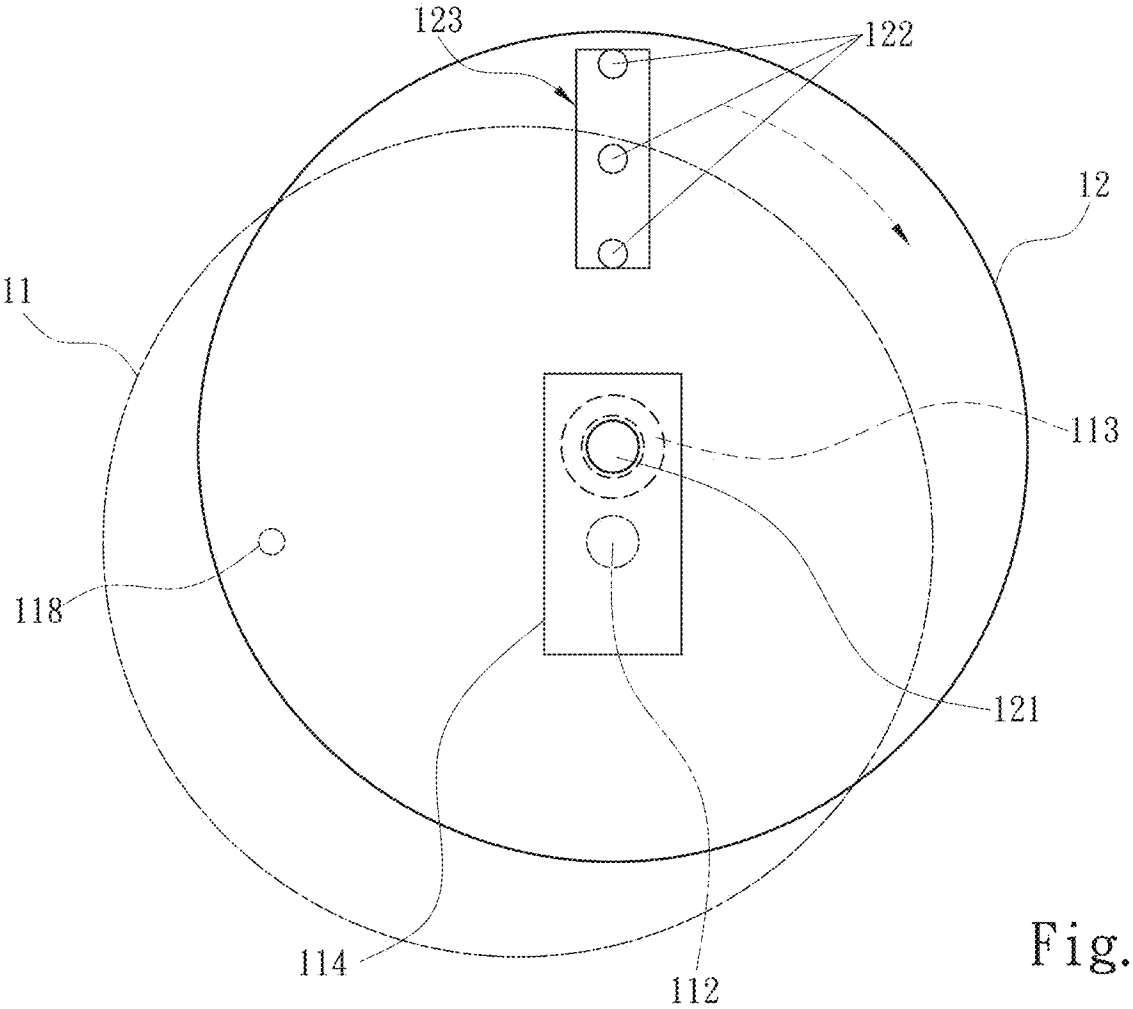
FIG. 11 is a first schematic diagram of the operation of the grinding disc of the present invention.
Figure 12:
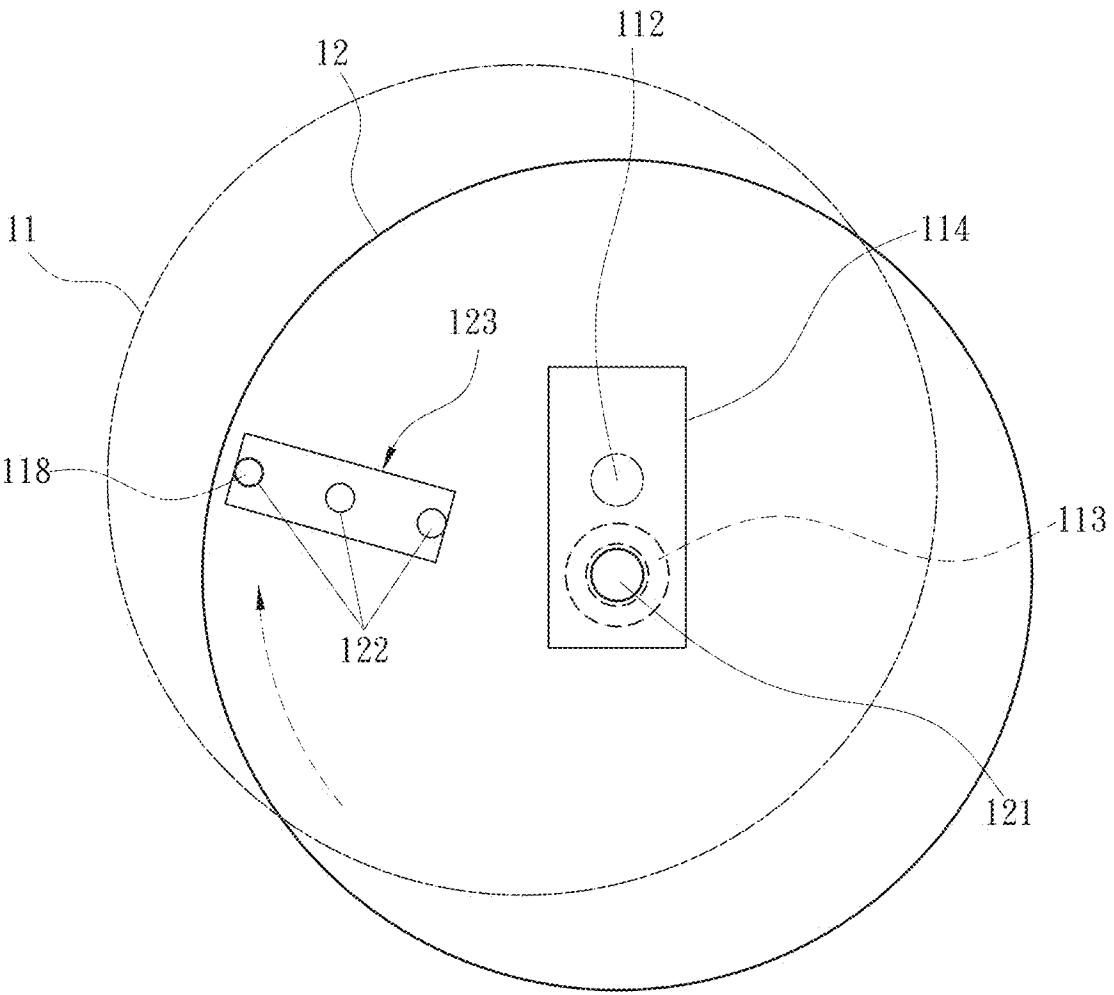
FIG. 12 is a second schematic diagram of the operation of the grinding disc of the present invention.
Figure 13:
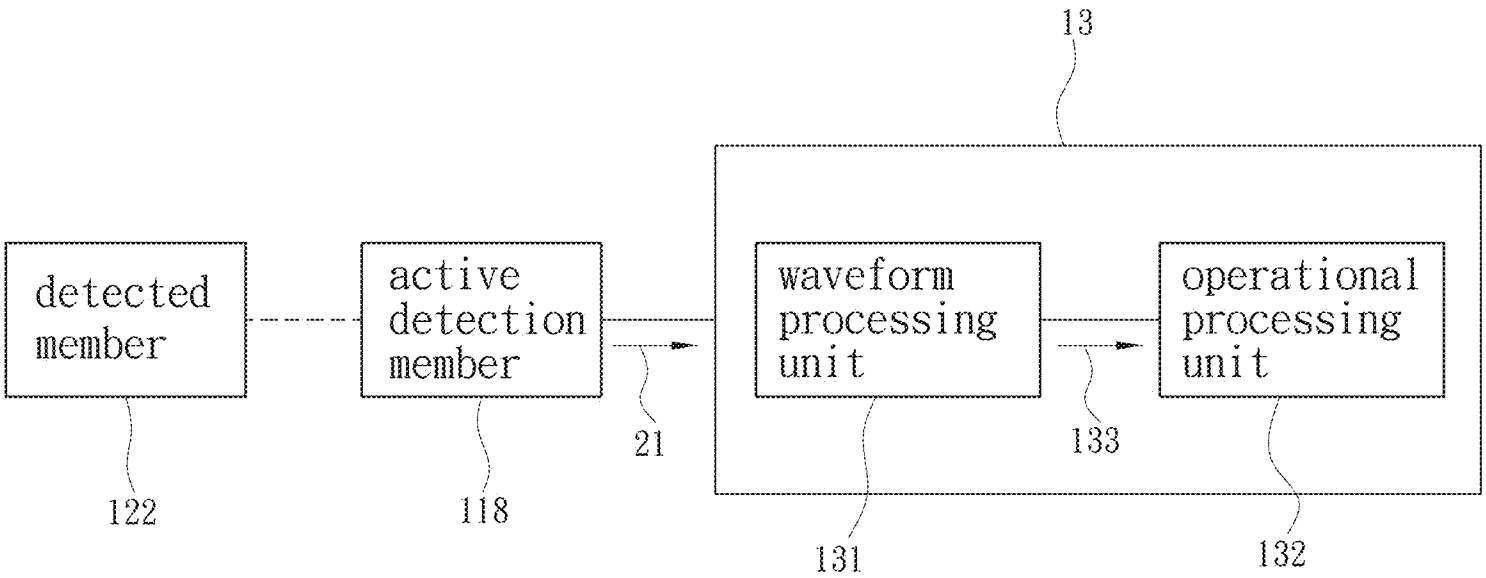
FIG. 13 is a first block diagram of units of the grinding machine tool of the present invention.

Referring to FIG. 7 and FIG. 13, the grinding machine tool 10 comprises an active detection member 118, and the active detection member 118 faces the grinding disc 12 to detect the detected member 122 to output a detection signal 21. Furthermore, the active detection member 118 of the present invention may be disposed on a mechanical arm, or externally attached to the body 11 by a connection component, or disposed on a side of the body 11 facing the grinding disc 12 (as shown in FIG. 10). The active detection member 118 does not change position when the grinding disc 12 performs the random eccentric orbital motion, that is, during the rotation of the grinding disc 12, the active detection member 118 does not chase the detected member 122, but waits stilly for the detected member 122 to pass. Moreover, when the grinding disc 12 is not rotating and the active detection member 118 directly faces the detection area 123, a projected position of the active detection member 118 will be located at the center of the detection area 123. In one embodiment, a distance between a center point of the driving shaft 112 and a center point of the active detection member 118 is equal to a distance between a center point of the mounting member 121 and a center point of the detection area 123. In addition, the active detection member 118 is designed to be positioned above the motion locus of the detection area 123, so that the detected member 122 may be detected once by the active detection member 118 when the grinding disc 12 rotates one turn relative to the body 11 each time. Referring to FIG. 10, FIG. 11, and FIG. 12, when the grinding disc 12 is provided with the plurality of detected members 122, the grinding disc 12 continuously changes position in the process of performing the random eccentric orbital motion, and the active detection member 118 does not always detect the same detected member 122, but randomly senses one of the plurality of detected members 122 based on the current state of the grinding disc 12.

Figure 14:
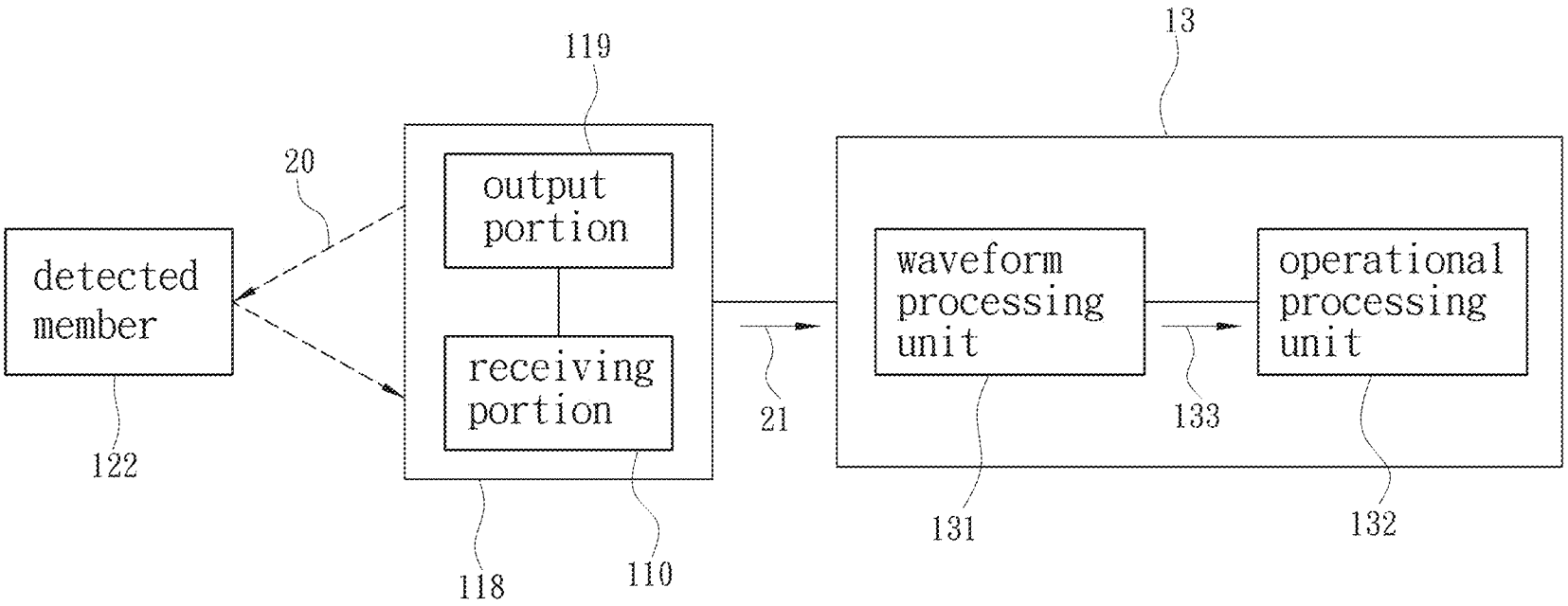
FIG. 14 is a second block diagram of units of the grinding machine tool of the present invention.

Referring to FIG. 14, in one embodiment, the active detection member 118 comprises an output portion 119 that emits a detection wave 20 toward the detected member 122, and a receiving portion 110 that receives the detection wave 20 reflected by the detected member 122 to output the detection signal 21, wherein the detection wave 20 is selected from one of a group consisting of a light ray, a radio wave, and a sound wave.

Explanation is made when the detection wave 20 is the light ray, in this embodiment, the at least one detected member 122 is a reflector, and the active detection member 118 is an optical transceiver. Further, the detection wave 20 may be infrared or laser. In implementation, the active detection member 118 is controlled to project the light ray toward the grinding disc 12, when the grinding disc 12 is rotated to a position that the detection area 123 facing the active detection member 118, the detected member 122 in the detection area 123 reflects the light ray, so that the active detection member 118 receives the reflected light ray to output the detection signal 21. Accordingly, the present embodiment may be applied to a site where there is no strong light source interference in the grinding operation environment. On the other hand, explanation is made when the detection wave 20 is the radio wave. Firstly, the radio wave may be referred to as a radio frequency, and therefore, in this embodiment, the detected member 122 and the active detection member 118 is implemented by radio frequency identification architecture. Further, the detected member 122 is a radio frequency tag, and the active detection member 118 is a radio frequency reader. In implementation, the active detection member 118 may be configured to send a radio frequency signal toward the grinding disc 12 over a long period of time, when the detected member 122 being the radio frequency tag enters a reading range of the active detection member 118, the active detection member 118 completes reading to output the detection signal 21. Moreover, the present embodiment may be applied to a site where there is no strong electric wave interference in the grinding operation environment. Furthermore, explanation is made when the detection wave 20 is the sound wave, the detected member 122 may be a structure that causes the surface of the grinding disc 12 to be uneven, or an object with acoustic impedance different from that of the grinding disc 12, and the active detection member 118 is a sound wave detector. In implementation, the active detection member 118 emits the sound wave toward the grinding disc 12 over a long period of time, and the sound wave will generate different reflected waves due to the difference in the surface state of the grinding disc 12 or difference in the acoustic impedance of the grinding disc 12. The active detection member 118 generates different signals based on the reflected waves to output the detection signal 21.

In addition to the foregoing, the active detection member 118 of the present invention may also generate the detection signal 21 based on the magnetic field strength changed by the detected member 122. For example, the detected member 122 is a magnet, and the active detection member 118 is a Hall detector. In implementation, when the detected member 122 passes the active detection member 118, the detected member 122 being the magnet causes the active detection member 118 to detect an increase in the magnetic field strength, and the active detection member 118 converts the magnetic signal into an electrical signal according to the magnetic signal to output the detection signal 21. Accordingly, the present embodiment may be applied to grinding operation in which the ground object is a non-metallic material. In addition to the foregoing, the detected member 122 and the active detection member 118 is implemented by a proximate switch structure. Specifically, the detected member 122 is an iron plate, and the active detection member 118 is consisting of a field coil and a magnetic field change signal detection unit. In implementation, the field coil is energized to establish a magnetic field, and the detected member 122 causes magnetic loss when passing through the magnetic field, and the magnetic field change signal detection unit generates the different detection signals 21 due to the impedance variation caused by the magnetic loss. The rotational speed of the random eccentric orbital motion is obtained through the difference in the detection signals 21. Moreover, the present embodiment may be applied to a site where there is no high-frequency signal interference in the grinding operation environment.

Referring to FIG. 13, the grinding machine tool 10 may further comprise an information processing module 13 connected to the active detection member 118 and generating a random eccentric orbital motion rotational speed per minute data based on the detection signal 21, and the information processing module 13 may be disposed on the mechanical arm or in a control device for managing the operation of the mechanical arm. In addition, in the embodiment where the active detection member 118 is disposed on the body 11, the information processing module 13 may also be mounted in the body 11. Moreover, in one embodiment, the information processing module 13 may be designed to have the ability to control the active detection member 118 to turn on and turn off. Furthermore, the information processing module 13 may be connected informatively to an external electronic device by wire or wirelessly to transmit the random eccentric orbital motion rotational speed per minute data to the external electronic device, so that the external electronic device may perform relative operational management based on the random eccentric orbital motion rotational speed per minute data, and the external electronic device may be the aforementioned control device in one embodiment. Referring to FIG. 13, in one embodiment, the information processing module 13 includes a waveform processing unit 131 and an operational processing unit 132 connected to the waveform processing unit 131. The main function of the waveform processing unit 131 is to perform noise filtering for the detection signal 21 outputted by the active detection member 118, and then output a detection waveform signal 133 to the operational processing unit 132. Further, the waveform processing unit 131 may be a digital wave filter. After the operational processing unit 132 receives the detection waveform signal 133, the operational processing unit 132 generates the random eccentric orbital motion rotational speed per minute data based on a program operation written in advance. Accordingly, the information processing module 13 is implemented by a plurality of electronic components that generate electrical connection relationship.

Accordingly, the present invention provides a technical means for detecting the speed of the random eccentric orbital motion of the grinding disc 12, which solves the problem that the prior art cannot detect and can only estimate the speed of the random eccentric orbital motion by the rotational speed of the driving shaft 112, resulting in the incapability of precisely controlling the precision industrial grinding performed by automated equipment.

What is claimed is:

1. A grinding machine tool with random eccentric orbital motion speed detection, the grinding machine tool comprising a body and a grinding disc, the body comprising a driving shaft and a tool holder connecting the grinding disc and having an eccentric distance relative to the driving shaft, and the grinding disc performing grinding in a random eccentric orbital motion when the driving shaft is rotating, the grinding machine tool, wherein the improvement comprises:

at least one detected member is provided on a side of the grinding disc facing the body, the at least one detected member defines a detection area, a length of the detection area is greater than or equal to twice the eccentric distance, and a rotational speed of the random eccentric orbital motion is obtained by detecting the at least one detected member; and the grinding machine tool is provided with an active detection member that faces the grinding disc, and the active detection member is configured to detect the at least one detected member without changing position when the grinding disc performs the random eccentric orbital motion, and the active detection member is configured to output a detection signal.

2. The grinding machine tool with random eccentric orbital motion speed detection as claimed in claim 1, wherein a number of the at least one detected member is provided on the side of the grinding disc is one, and two opposite boundaries of the detected member define the detection area with a range greater than or equal to twice the eccentric distance.

3. The grinding machine tool with random eccentric orbital motion speed detection as claimed in claim 1, wherein the at least one detected members comprises a plurality of the detected members, and wherein the plurality of the detected members are provided on the side of the grinding disc, the plurality of detected members are located on a same extension line, one of the plurality of detected members is located at a center of the detection area, and two of the plurality of detected members are respectively spaced the eccentric distance apart with the one of the plurality of detected members located at the center of the detection area.

4. The grinding machine tool with random eccentric orbital motion speed detection as claimed in claim 1, wherein the grinding machine tool is further provided with an information processing module that connects to the active detection member, and the information processing module is configured to generate a random eccentric orbital motion rotational speed per minute data based on the detection signal.

5. The grinding machine tool with random eccentric orbital motion speed detection as claimed in claim 1, wherein the active detection member comprises an output portion that emits a detection wave toward the at least one detected member, and a receiving portion that receives the detection wave reflected by the at least one detected member to output the detection signal, and the detection wave is selected from one of a group consisting of a light ray, a radio wave, and a sound wave.

6. The grinding machine tool with random eccentric orbital motion speed detection as claimed in claim 1, wherein a projected position of the active detection member is located at the center of the detection area when the grinding disc is not rotating.

7. The grinding machine tool with random eccentric orbital motion speed detection as claimed in claim 6, wherein the active detection member is disposed on the body and located on a side of the body facing the grinding disc.

8. The grinding machine tool with random eccentric orbital motion speed detection as claimed in claim 1, wherein the active detection member generates the detection signal based on a magnetic field strength changed by the at least one detected member.

9. The grinding machine tool with random eccentric orbital motion speed detection as claimed in claim 8, wherein the active detection member is disposed on the body and located on a side of the body facing the grinding disc.

10. The grinding machine tool with random eccentric orbital motion speed detection as claimed in claim 1, wherein the active detection member is disposed on the body and located on a side of the body facing the grinding disc.

11. The grinding machine tool with random eccentric orbital motion speed detection as claimed in claim 10, wherein the active detection member comprises an output portion that emits a detection wave toward the at least one detected member, and a receiving portion that receives the detection wave reflected by the at least one detected member to output the detection signal, and the detection wave is selected from one of a group consisting of a light ray, a radio wave, and a sound wave.

12. The grinding machine tool with random eccentric orbital motion speed detection as claimed in claim 10, wherein the active detection member generates the detection signal based on a magnetic field strength changed by the at least one detected member.

13. The grinding machine tool with random eccentric orbital motion speed detection as claimed in claim 11, wherein the grinding machine tool comprises an information processing module that connects to the active detection member, and the information processing module is configured to generate a random eccentric orbital motion rotational speed per minute data based on the detection signal.

14. The grinding machine tool with random eccentric orbital motion speed detection as claimed in claim 13, wherein the information processing module comprises a waveform processing unit and an operational processing unit, and wherein the operational processing unit connects to the waveform processing unit, and the operational processing unit is configured to analyze a detection waveform signal outputted by the waveform processing unit to generate the random eccentric orbital motion rotational speed per minute data.

15. The grinding machine tool with random eccentric orbital motion speed detection as claimed in claim 1, wherein the active detection member is externally attached to the body by a connection component.

16. The grinding machine tool with random eccentric orbital motion speed detection as claimed in claim 15, wherein the active detection member is disposed on a side of the body facing the grinding disc, the grinding machine tool comprises an information processing module that connects the active detection member, the information processing module is configured to generate a random eccentric orbital motion rotational speed per minute data based on the detection signal, and the information processing module is disposed in the body and connected to the active detection member.

17. The grinding machine tool with random eccentric orbital motion speed detection as claimed in claim 16, wherein the information processing module comprises a waveform processing unit and an operational processing unit, and wherein the operational processing unit connects the waveform processing unit, and the operational processing unit is configured to analyze a detection waveform signal outputted by the waveform processing unit to generate the random eccentric orbital motion rotational speed per minute data.

* * * * *